US008413836B2

(12) United States Patent
Senn et al.

(10) Patent No.: US 8,413,836 B2
(45) Date of Patent: Apr. 9, 2013

(54) PACKAGING SYSTEM WITH CROSS BRACE FOR LATERAL REINFORCEMENT

(75) Inventors: Jonathan Senn, Nashville, TN (US); Eric Zerfas, Hermitage, TN (US)

(73) Assignee: Sonoco Development, Inc., Hartsville, SC (US)

( * ) Notice: Subject to any disclaimer, the term of this patent is extended or adjusted under 35 U.S.C. 154(b) by 146 days.

(21) Appl. No.: 12/959,480

(22) Filed: Dec. 3, 2010

(65) Prior Publication Data

US 2012/0138618 A1 Jun. 7, 2012

(51) Int. Cl.
*B65D 25/54* (2006.01)
*B65D 6/22* (2006.01)

(52) U.S. Cl.
USPC ..... 220/662; 220/651; 220/652; 220/653; 220/654; 220/640; 220/639; 220/642; 220/588

(58) Field of Classification Search ..... 220/651–654, 220/639–640, 643, 756, 642, 3.92, 3.94, 220/657; 206/586, 521, 523, 326, 320, 756, 206/386, 280, 290, 588, 509, 598, 595, 397; 229/122.21, 122.27, 199, 117.09; 138/91, 138/106

See application file for complete search history.

(56) References Cited

U.S. PATENT DOCUMENTS

| | | | | | |
|---|---|---|---|---|---|
| 1,522,926 | A | * | 1/1925 | Wadsworth | 361/672 |
| 1,754,183 | A | * | 4/1930 | Wildberg | 217/19 |
| 3,493,101 | A | | 2/1970 | Collin | |
| 3,504,842 | A | * | 4/1970 | Grafslund | 206/320 |
| 4,655,364 | A | * | 4/1987 | Swapp et al. | 206/718 |
| 5,161,692 | A | * | 11/1992 | Knierim | 206/586 |
| 6,003,667 | A | * | 12/1999 | Barnett et al. | 206/396 |
| 6,116,423 | A | * | 9/2000 | Troxtell et al. | 206/523 |
| 6,749,108 | B2 | * | 6/2004 | Naughton et al. | 229/199 |
| 7,413,111 | B2 | | 8/2008 | Quaintance et al. | |

* cited by examiner

*Primary Examiner* — J. Gregory Pickett
*Assistant Examiner* — James M Van Buskirk
(74) *Attorney, Agent, or Firm* — Miller, Matthias & Hull LLP

(57) ABSTRACT

A packaging system for providing lateral support for a packaged appliance is provided. The packaging system comprises a carton sized to fit around the appliance and having opposing side walls, each having an aperture extending there through; a cross brace having opposing ends and a hollow interior space at each end, the cross brace extending between the first pair of opposing sidewalls such that the cross brace hollow interior space at each end communicates with an aperture; and a pair of plugs, each plug having an elongated body and a flange extending laterally from an end of the elongated body, the flange located adjacent the exterior surface of one of the first pair of opposing side walls, the body of the plug extending through the corresponding aperture and within the hollow interior space of one end of the cross brace so that together the plugs position and secure the cross brace within the carton.

4 Claims, 7 Drawing Sheets

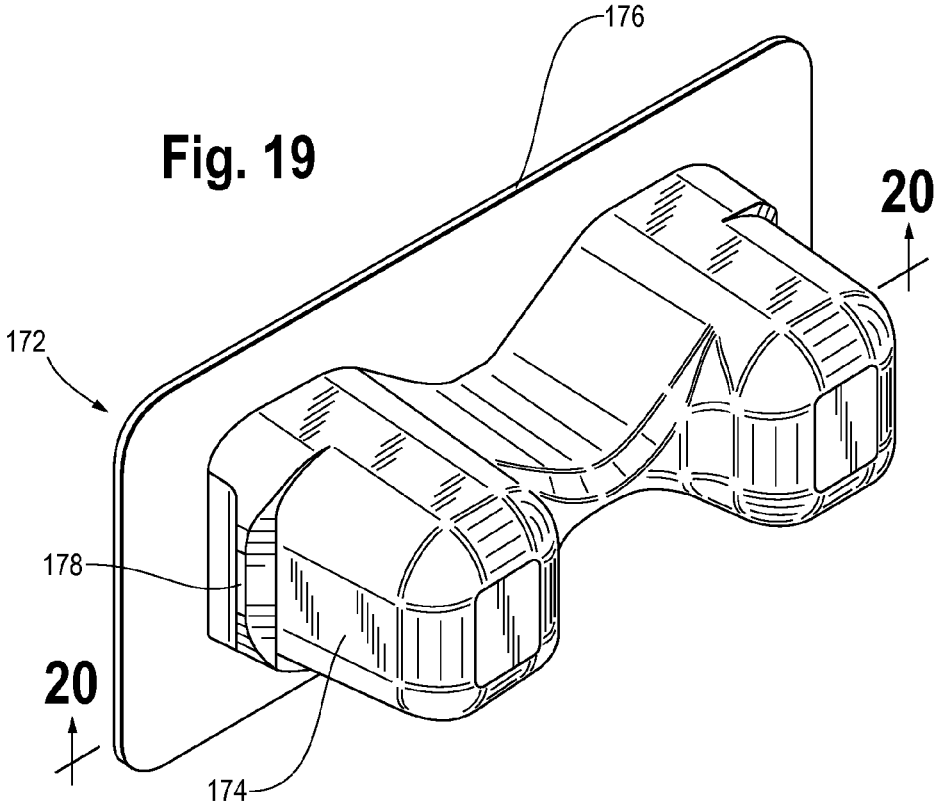
Fig. 19
Fig. 20
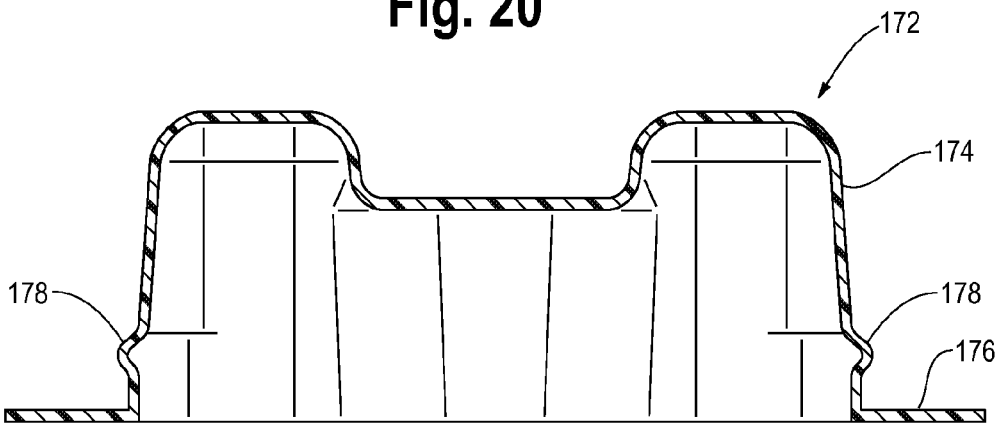

PACKAGING SYSTEM WITH CROSS BRACE FOR LATERAL REINFORCEMENT

BACKGROUND OF THE INVENTION

1. Field of the Invention

This invention patent relates to a packaging system. More particularly, this invention relates to a packaging system including a cross brace for lateral (horizontal) reinforcement and means for holding the cross brace in place.

2. Description of the Related Art

Packaged household appliances are sometimes transported by clamp trucks, which impose large lateral clamping forces on the sides of the packages. These clamping forces can damage the package contents unless the package is designed to withstand them. Traditionally appliance packages have been laterally reinforced with various packaging components placed inside the carton, such as folded corrugated board or support posts positioned horizontally within the package.

When using support posts in this manner, the posts need to be secured within the carton so they do not move. Various means for securing or holding lateral support posts in place have been devised, but they typically require a significant amount of material.

Thus it is an object of the present invention to provide a system for holding a lateral support post in place which uses less material than traditional systems and can withstand large lateral clamping forces.

Further and additional objects will appear from the description, accompanying drawings, and appended claims.

BRIEF SUMMARY OF THE INVENTION

The present invention fulfills these objectives by providing a packaging system in which a cross brace is held in place inside a carton with plugs.

In a first embodiment the system comprises a four sided carton sized to fit around the appliance and having opposing side panels with an aperture extending there through, a cross brace having opposing ends and a hollow interior space at each end, and a pair of plugs. The cross brace is disposed horizontally inside the carton between the opposing side panels so that the hollow interior space at each end is aligned with (communicates with) an aperture.

Each plug has a body portion and a flange extending laterally from one end of the body. The plugs are inserted into the carton apertures so that the body of each plug extends within the hollow interior space of the cross brace and the plug flange abuts the exterior surface of the carton side panel. In other words, each end of the cross brace fits around a plug body, preferably with a friction fit. Together the plugs position and secure the cross brace within the carton.

The plugs may be secured in the box wall apertures with a friction fit or with adhesive. The plug body may be tapered to make it easier to help nest multiple plugs during shipping. The plug bodies preferably are hollow so a user can insert their hands into the plugs to lift or otherwise maneuver the carton.

In a second embodiment each end of the cross brace fits inside a plug, rather than around the plug. In this second embodiment each plug has a hollow body open at a distal end (away from the flange) and closed at the proximal end. Each plug is inserted into one of the apertures so that the plug body fits around the cross brace and the plug flange abuts an exterior surface of a carton panel.

In a third embodiment each end of the cross brace rests on a shelf or ledge which is part of a U-shaped plug body. The U-shaped body has a bottom wall having two side edges and a side wall extending vertically upwardly from each bottom side edge to form the "U" shape. The plug flange extends laterally from a proximal end of the plug body. Each plug is inserted into one of the two apertures so that the plug body extends into the carton and the flange abuts an exterior surface of a carton panel. Each opposing end of the cross brace rests on one of the plug bottom walls. Preferably the distance between the inner surfaces of the plug side walls is about the same as the width as the cross brace so that the plug side walls and the cross brace form a friction fit. Alternatively, each plug may comprise projections extending inwardly from each sidewall to facilitate a friction fit between the cross brace and the plug body.

In a fourth embodiment the plugs are located entirely inside the carton along with the cross brace, rather than extending through apertures in the carton side panels. In this embodiment each plug comprises a substantially cylindrical body that fits snugly within an open end of the cross brace, and a flange that extends laterally from one end of the plug body and abuts an interior surface of one of the carton panels. Each flange may include an adhesive surface on its carton facing side that adheres the plug to an interior surface of one of the carton panels.

In a fifth embodiment the plugs again are located inside the carton, but each plug body fits around an end of the cross brace rather than within an open end of the cross brace. The plug body is open at the distal end and closed at the proximal (flange) end. As in the fourth embodiment the plug flange extends laterally from one end of the plug body and abuts an interior surface of one of the carton panels. Each flange may include an adhesive surface on its carton facing side that adheres the plug to an interior surface of one of the carton panels.

In a sixth embodiment of the invention the four sided carton is replaced by a Clearview packaging system having transparent sides. The reinforced Clearview package comprises a base, a top cap, corner posts, and a cross brace and plugs. The base comprises a rectangular bottom panel having four corners. The top cap comprises a rectangular top panel having four corners and two sets of opposing peripheral edges, two side panels extending downward from one set of opposing peripheral edges, each side panel having an aperture formed therein, and front and rear panels extending downward from the other set of opposing peripheral edges. Corner posts extend vertically between each of the four corners of the base and each of the four corners of the top cap. A cross brace is positioned horizontally in the top cap between the apertures. A pair of plugs, each having a body and a flange extending laterally from a proximal end of the body, are inserted into the two apertures so that the plug bodies extends within the cross brace and the plug flanges abut an exterior surface of a top cap side panel. Transparent plastic film may be wrapped around the base, top cap and corner posts.

BRIEF DESCRIPTION OF THE DRAWINGS

FIG. 19 is a perspective view of a plug having exterior notches.

FIG. 20 is a top plan view of the plug of FIG. 19.

DETAILED DESCRIPTION OF THE INVENTION

Figure 1:
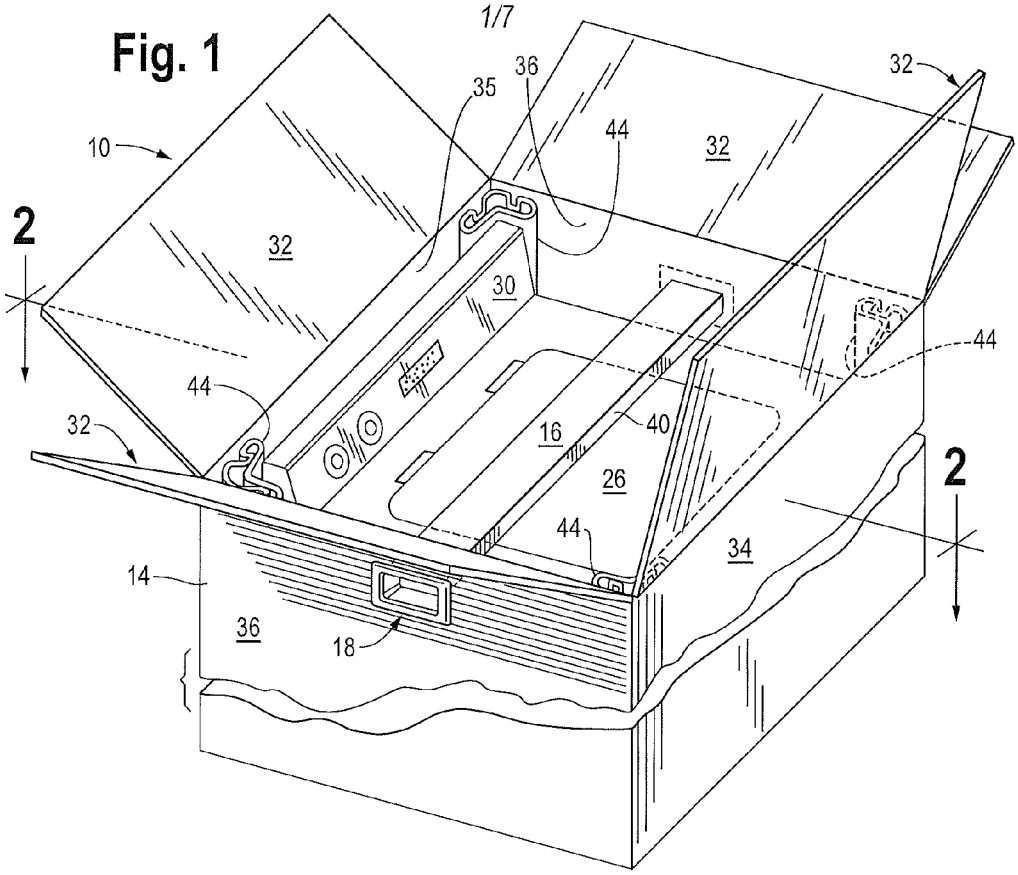
FIG. 1 is a perspective view of a reinforced packaging system according to the present invention.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

The Invention

First Embodiment

Figure 2:
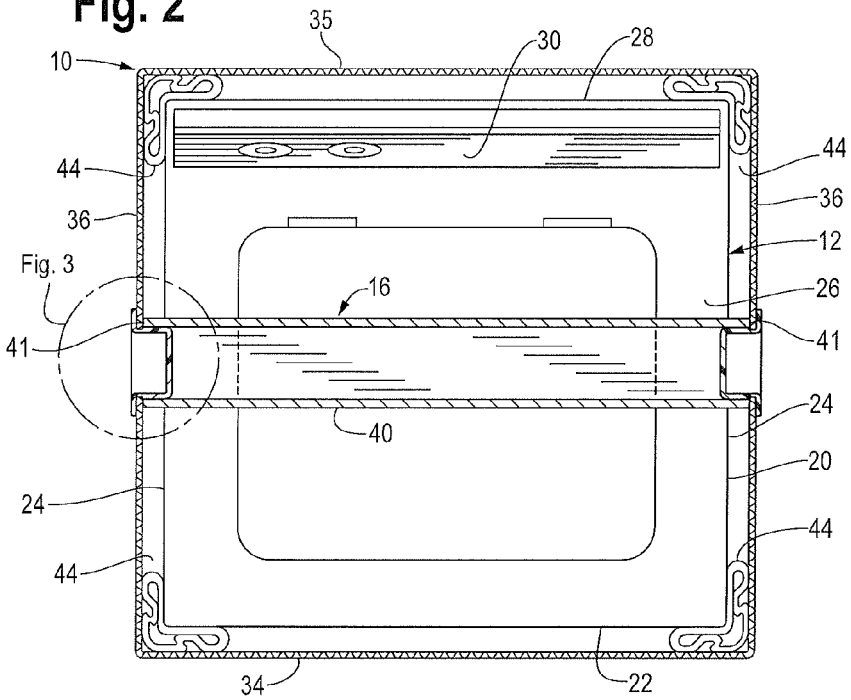
FIG. 2 is a cross-sectional view of the packaging system of FIG. 1 taken along line 2-2.
Figure 3:
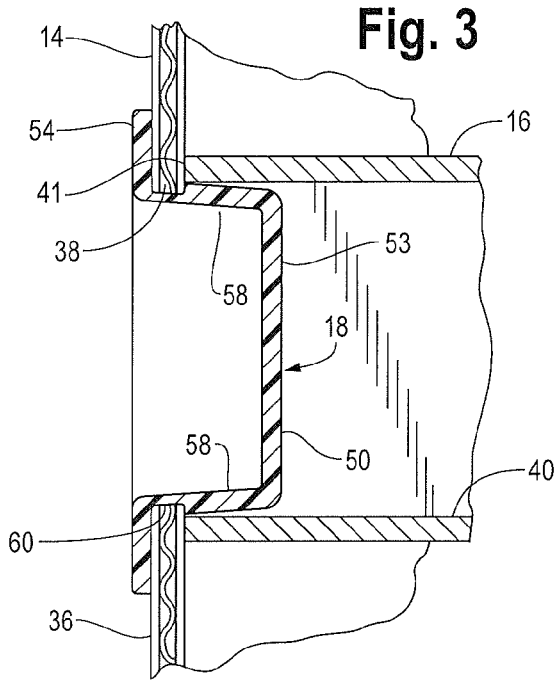
FIG. 3 is an enlarged view of a portion of FIG. 2.

Turning to the drawings, there is shown in FIGS. 1-3 one embodiment of the present invention, a packaging system 10 including means for protecting a packaged article 12 against lateral forces such as those experienced during clamp handling. The packaging system 10 comprises a four sided box or carton 14 disposed around the article 12, a cross brace 16 positioned inside the carton 14, and a pair of cross brace holding devices or plugs 18 designed to fit within opposing ends of the cross brace 16 to hold it in place within the carton 14. Vertical corner posts 44 may be inserted between the appliance corners and the carton corners to protect the appliance 12 and provide axial (vertical) support.

In the illustrated embodiments the article 12 is a large household appliance of the type having a substantially rectilinear metal cabinet 20 comprising a front panel 22, two side panels 24, a top panel 26 and a rear panel 28. A control console 30 extends upwardly from the rear portion of the top panel 26.

The carton 14 is sized to fit around the appliance 12 or other packaged article, and typically comprises folded bottom panels (not shown), top panels 32, a front panel 34, a rear panel 35 and two opposing side panels 36. The front, rear and side panels form a cylindrical sleeve which surrounds the four sides of the appliance 12. (As used herein the term "cylindrical" means the shape defined by a straight line moving parallel to a fixed straight line and intersecting a closed planar shape. Thus, if the closed planar shape is a rectangle, then the cylinder would have a rectangular cross section. If the closed planar shape is a circle, then the cylinder would have a circular cross section. And if the closed planar shape is an irregular shape, then the cylinder would have an irregular shaped cross section.)

In an important aspect of the invention, an aperture 38 is cut into or otherwise formed in each of the side panels 36. The two apertures 38 are co-aligned and located at a height above the appliance top panel 26 to allow clearance for the cross brace 16.

The cross brace 16 comprises a substantially cylindrical body 40 having two opposing ends 41. The cross brace 16 is hollow throughout its length and may or may not have strengthening beads longitudinally disposed along the length of the cross brace 16 as discussed further below. The cross brace 16 may be made of any suitable material, including wood, paper or plastic. However, it has been found that a convolutely wound paper post, such as those available from Sonoco Products Company of Hartsville, S.C. under the trademark SONOPOST®, is suitable for use as a cross brace in the present invention due to the surprising strength and buckling resistance in the longitudinal direction of such posts. However, any post or elongated support structure having sufficient strength and buckling resistance in the longitudinal direction to protect an appliance package from lateral forces can be used.

The cross brace 16 should have a length substantially the same as the internal lateral dimension of the carton 14, either from side panel 24 to side panel 24, or from front panel 22 to rear panel 28, depending upon which direction the extra lateral support is needed. The ends 41 of the cross brace 16 should have a cross sectional shape that is substantially the same as that of the apertures 38 and that also causes the cross brace 16 to fit snugly around the plug bodies 50 as shown in FIGS. 2 and 3.

Figure 4:
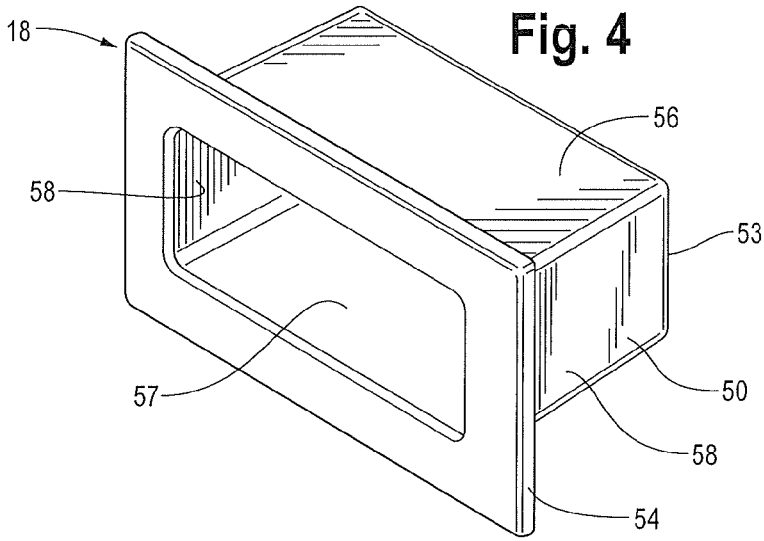
FIG. 4 is a perspective view of one of the plugs of FIG. 1.
Figure 5:
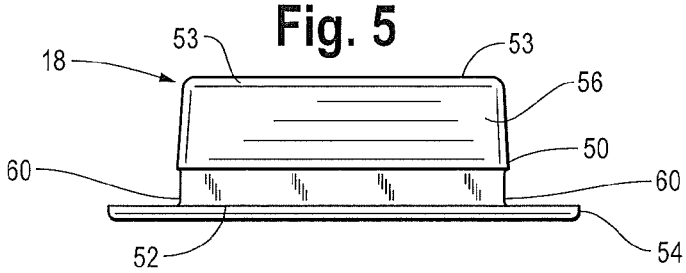
FIG. 5 is a top plan view of the plug of FIG. 4.

FIGS. 4 and 5 provide two additional views of the plugs 18 of FIGS. 1-3. Each plug 18 comprises a substantially cylindrical body 50 having a proximal end 52 and a distal end 53, and a flange 54 extending laterally from (perpendicular to the axis of) the body 50 at its proximal end 52. The plug body 50 comprises a top wall 56, a bottom wall 57 and opposing side walls 58 connecting the top and bottom walls 56, 57. In this first embodiment the plug body 50 (and the cross brace 16) has a substantially rectangular cross sectional profile.

The plugs 18 should fit snugly within the carton apertures 38 and inside the hollow ends of the cross brace 16. When inserted into the aperture 38, the plug body 50 may be held secure to the carton side panel 36 with a friction fit or with adhesive. A preferred way to achieve a friction fit is to configure (shape) the plug bodies 50 so that their outer surface shape is substantially the same as the shape of the apertures 38 and the interior shape of the cross brace 18. As shown in FIG. 5 the proximal end 52 of the plug body 50 may have a groove 60 formed peripherally therein adjacent the flange 54 to help register the plug 18 with the carton side panel 36.

The plug flange 54 is substantially planar with peripheral dimensions larger than the cross sectional dimensions of the proximal end of plug body 50 and, therefore, the aperture 38. The flange 54 should have a large outer facing surface, and be shaped to prevent the plug 18 from being pushed through the aperture 38. Typically, this is accomplished by providing a flange 54 having a height and width larger than the height and width of the aperture 38. The large outer facing surface of the flange 54 also assures that the flanges 54 from adjacent packaging units 10 will align and substantially abut each other so that clamping forces can be transferred through the plug and cross brace system from one unit 10 to the next, thereby minimizing problems associated with offset units 10.

The plug 18 may be made of metal, plastic or any suitable material, and may be manufactured by blow molding or any suitable method. Preferably the plug body 50 is hollow and the flange 54 includes a central opening large enough to accommodate at least part of a hand to save material and to provide a handle hold for a user.

The invention may be used in the following manner. First, a carton 14 having opposing, linearly aligned apertures 38 is positioned around an appliance 12. Optional vertical corner posts or supports 44 may be inserted between the appliance 12 and carton 14 at the four vertical edges of the appliance for axial (vertical) strength.

Next, the cross brace 16 is positioned within the carton 14 with its hollow ends 41 communicating with (aligned with) the apertures 38 in the carton side walls 36.

Next, a plug 18 is inserted into each aperture 38, preferably until the plug flange 54 abuts the outer surface of the carton side panel 36. When fully inserted into the aperture 38 the plug body 50 should extend a substantial distance inside the hollow interior of cross brace 16 and fit snugly therein. The plugs 18 may be secured to the carton panels 36 with a friction fit or with adhesive. Together the two plugs 18 position and secure the cross brace 16 laterally within the carton 14, and may be used as handles if the plugs 18 are hollow.

Figure 6:
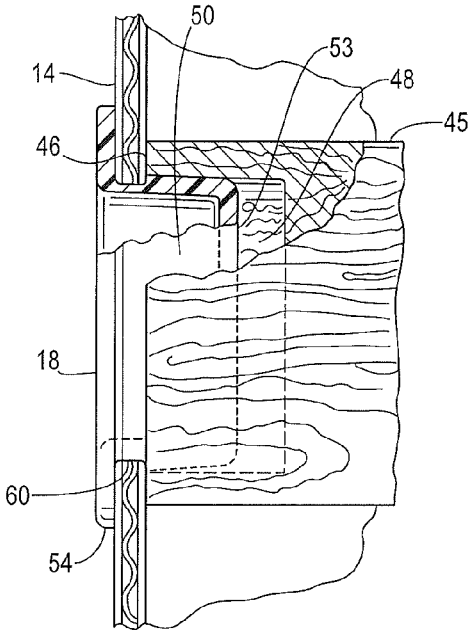
FIG. 6 is a top view of an alternative embodiment of the invention, one in which the cross brace is hollow only at its ends.

The packaging system of the present invention may also employ a cross brace 45 that is hollow only at the ends 46 as shown in FIG. 6. The hollow interior space 48 at each end 46 should be at least as deep as the axial length of the plug body 50 to allow the plug flange 54 to fit snugly against the carton 14.

Figure 15:
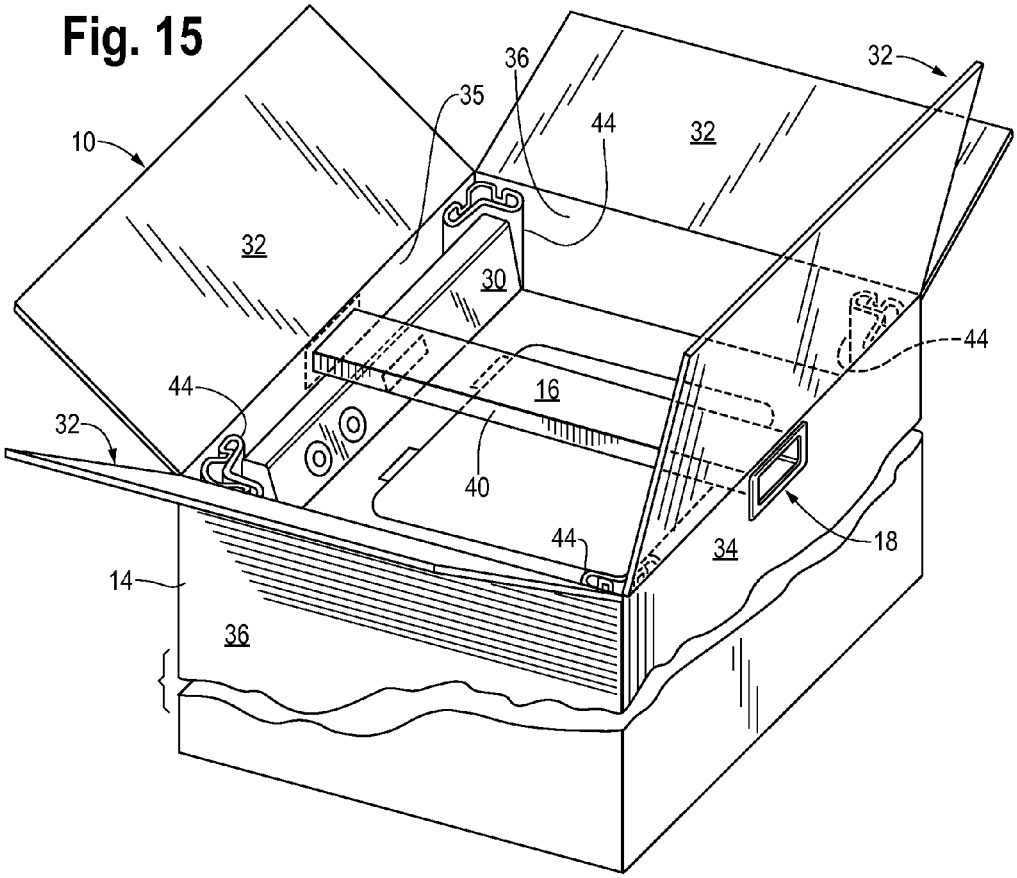
FIG. 15 is a perspective view of the cross brace and plug of FIG. 1 with the cross brace installed front to back.

FIG. 15 is a perspective view of the same invention but with the cross brace 18 installed front to back to provide front to back lateral support. The apertures 38 are located in the carton front and rear panels 34, 35. If the appliance 12 includes a control console 30, the apertures 38 must be located above a plane defined by the top of the control console 30 to provide clearance space for the cross brace 16.

Figure 16:
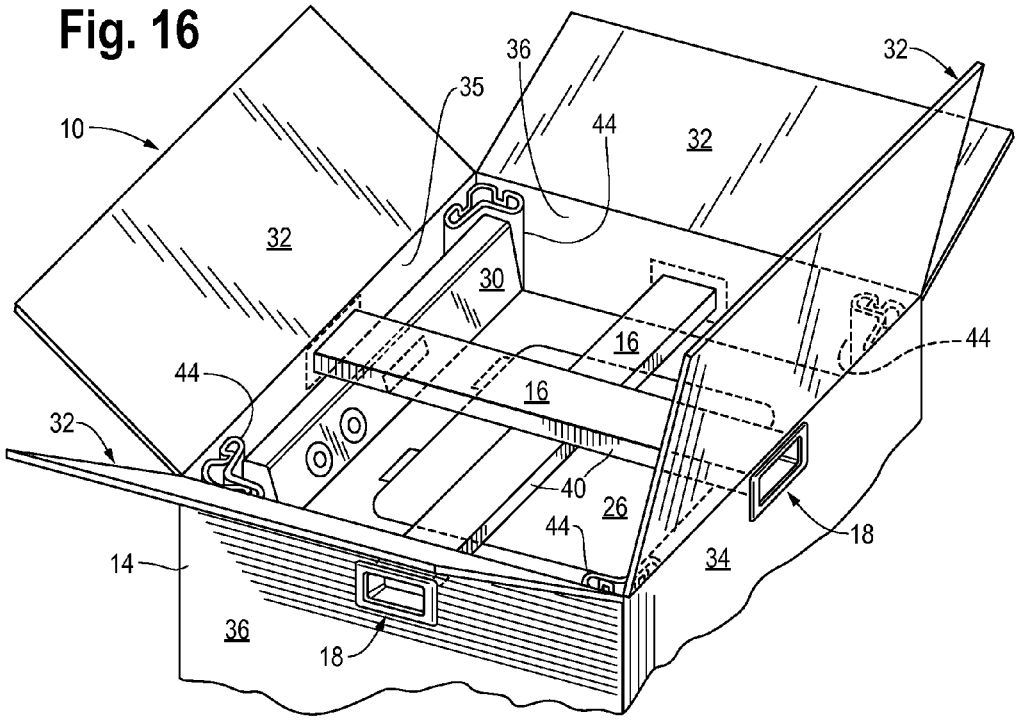
FIG. 16 is a perspective view of a reinforced packaging system according to the present invention having two orthogonally oriented cross braces.

FIG. 16 is a perspective view of a reinforced packaging system according to the present invention having two cross braces 16 arranged orthogonally (perpendicularly) to each other to provide a package having both side to side reinforcement and front to back reinforcement. The carton 14 has a first set of opposing, linearly aligned apertures 38 disposed in its side walls 36 and a second set of opposing, linearly aligned apertures 38 disposed in its front and rear walls 34, 35. Vertical corner posts 44 are inserted between the appliance 12 and carton 14 at the four vertical edges of the appliance.

A first cross brace 16 is positioned within the carton 14 with its hollow ends 41 communicating with (aligned with) the apertures 38 in the carton side walls 36. Plugs 18 are inserted into each aperture 38 until the plug flanges 54 abut the outer surface of the carton side panels 36. A second cross brace 16 is positioned within the carton 14 with its hollow ends 41 communicating with (aligned with) a pair of apertures 38 disposed in the carton front and rear walls 34, 35. The two sets of plugs 18 may be secured to the carton panels 34, 35, 36 with a friction fit or with adhesive. Together plugs 18 position and secure the two cross braces 16 within the carton 14. The two sets of opposing apertures, and thus the cross braces themselves, must be vertically offset so as not to interfere with each other when installed. Preferably, the front to back cross brace 16 is offset higher than the side to side cross brace 16, since the front to back cross brace 16 must also clear the appliance control console 30. The resulting package has improved lateral reinforcement in both the side to side and front to rear directions.

Second Embodiment

Figure 7:
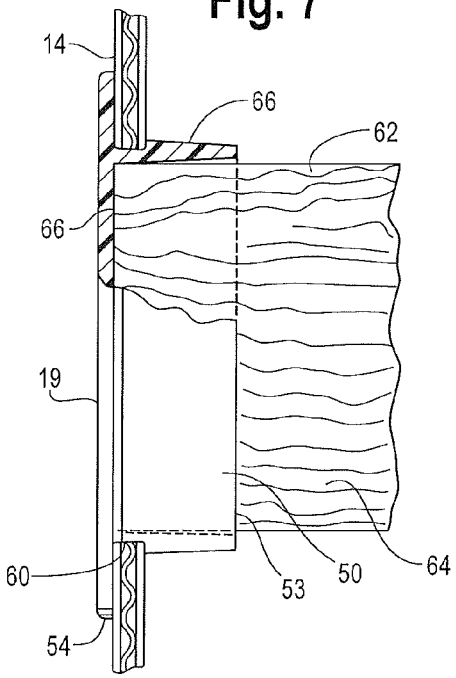
FIG. 7 is a top view of a second embodiment of the invention, one in which the cross brace fits within a plug body.

In a second embodiment of the invention shown in FIG. 7, the cross brace fits within the plug body instead of around the plug body as in FIGS. 1-6. This embodiment may comprise a cross brace having hollow ends as in FIGS. 1-6, or a cross brace 62 that is solid throughout (from end to end), having both a solid body 64 and solid ends 66.

Referring to FIG. 7, each plug 19 comprises a body 50 having a closed proximal or flange end 54 and open distal end 53 for receiving the cross brace 62. Each plug 19 further comprises a flange 54 extending laterally from the proximal end of the body 50. As already noted, instead of fitting around the plug body 50 as in FIG. 6, each end 66 of the cross brace 62 fits snugly within the plug body 50. Each plug 19 is positioned within an aperture 38 so that the body 50 fits snugly around the cross brace 62 and the flange 54 abuts an exterior surface of a carton panel. The plugs 19 position and secure the cross brace 62 within the carton 14.

Third Embodiment

In a third embodiment of the invention each end of the cross brace rests on a shelf or ledge which is part of a U-shaped plug body. The U-shaped body has opposing ends, a bottom wall having two side edges, and a side wall extending vertically upwardly from each bottom side edge. The plug flange extends laterally from the proximal end of the plug body. Each plug is inserted into one of the two apertures so that the plug body extends into the carton and the flange abuts an exterior surface of a carton panel. Each opposing end of the cross brace rests on one of the plug bottom walls.

Preferably the distance between the inner surfaces of the plug side walls is about the same as the width as the cross brace so that the plug side walls and the cross brace form a friction fit. Alternatively, each plug may further comprise projections extending inwardly from each sidewall to facilitate a friction fit between the cross brace and the plug body.

Figure 11:
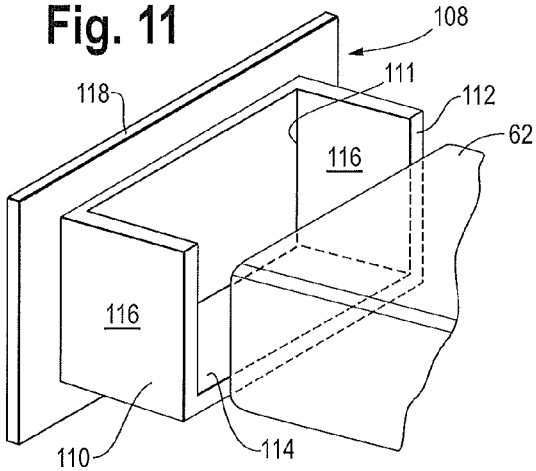
FIG. 11 is a perspective view of a third embodiment of the invention, one in which the plug functions as a shelf or ledge for the cross brace.

FIG. 11 is a perspective view of a plug 108 having a U-shaped body 110. The U-shaped body 110 has opposing ends 111, 112, a bottom wall 114 having two ends and a side wall 116 extending vertically upwardly from each bottom wall end. A flange 118 extends laterally from the proximal end 111 of the plug body 110. The bottom wall 114 functions as a ledge or shelf on which the cross brace 106 can rest. Preferably the distance between the inner surfaces of the plug side walls 116 is about the same as the width of the cross brace 106 so that the two parts form a friction fit. The cross brace 106 can be dropped into place after the plugs 108 have been inserted into the carton apertures 38.

Alternative Plug Embodiments

Figure 8:
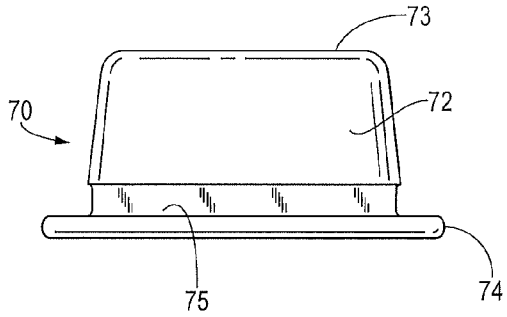
FIG. 8 is a top plan view of a plug having a tapered body.

Various other alternative plug designs are contemplated. For example, FIG. 8 shows a plug 70 having a conical or tapered body 72 with the distal end 73 having a smaller cross sectional area than the proximal end 75. The tapered body 72 enables multiple plugs 70 to be nested so they occupy less space. The tapered body 72 also facilitates insertion of the plug 70 into a carton aperture 38.

Figure 9:
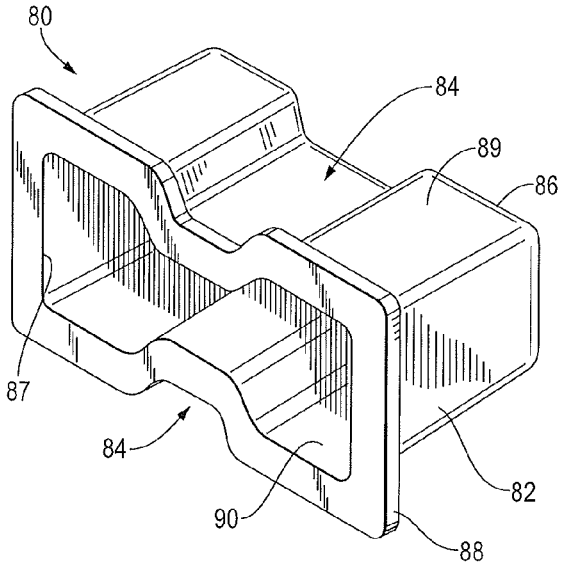
FIG. 9 is a perspective view of a plug having a contoured or beaded body.

FIG. 9 is a perspective view of a plug 80 comprising a substantially cylindrical body 82 having integrally formed opposing beads 84 in the axial direction. The plug 80 has opposing ends 86, 87 and a flange 88 extending laterally from one end 87. The plug body 88 has top and bottom walls 90 and side walls 92 connecting the top and bottom walls 89, 90. The beads 84 extend inwardly from the top and bottom walls 89, 90. A beaded plug 80 such as this may be used with a cross brace having similar opposing beads, with the cross brace fitting either inside or outside the plug body 82.

Still other embodiments of plugs that may be used as part of the packaging system of the present invention are shown in FIGS. 10-14. These plugs are primarily intended for use with solid cross braces, but may be used with hollow cross braces as well.

Figure 10:
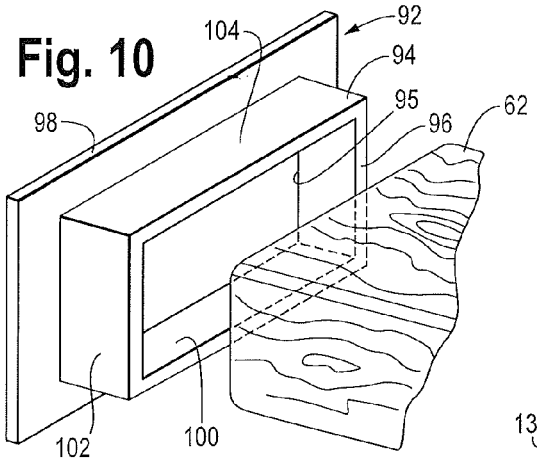
FIG. 10 is perspective view of a plug having a shortened body.

FIG. 10 is a perspective view of a plug 92 having a shortened body 94. The plug body 94 has opposing ends 95, 96. A flange 98 extends laterally from the proximal end 95. The plug body 94 comprises a bottom wall, two side walls 102 extending vertically upward from the bottom wall 100, and a top wall 104. The plug body 94 has a substantially rectangular cross sectional profile and is configured to receive within its perimeter a cross brace 106. The cross brace 106 may be solid as shown in the figure, since it will fit inside the plug body 94, preferably forming a friction fit therein, but may also be hollow in part or in whole. The internal height and width of the plug body 94 should be about the same as the height and width of the cross brace 106 so that the two parts form a friction fit.

Figure 12:
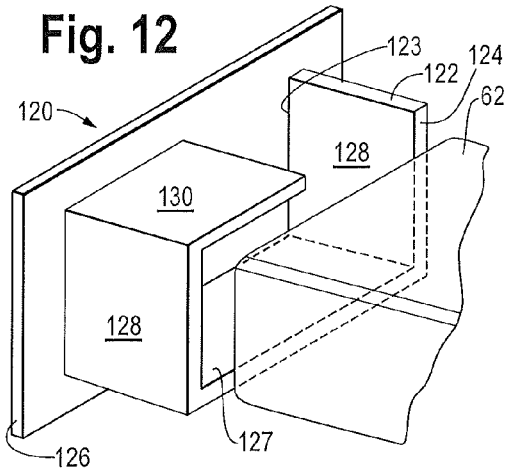
FIG. 12 is a perspective view of another plug according to the present invention.

FIG. 12 is a perspective view of still another plug 120 suitable for use with the present invention as a shelf or ledge for a cross brace. The plug 120 comprises a body 122 having opposing ends 123, 124 and a flange 126 extending laterally from the proximal end 123. The plug body 122 comprises a bottom wall 127 having two ends and a side wall 128 extending vertically upwardly from each bottom wall end. The plug bottom wall 127 functions as a ledge or shelf upon which a cross brace can rest. Preferably the distance between the inner surfaces of the plug side walls 128 is about the same as the width of the cross brace so that the two parts form a friction fit. A partial top wall 130 extends horizontally from the top end of one of the side walls 128 toward the other side wall 128 to prevent the cross brace from being easily removed once the cross brace is inserted within the plug body 122. The top wall 130 may be affixed to the side wall 128 in a stationary manner or hingedly attached thereto.

Figure 13:
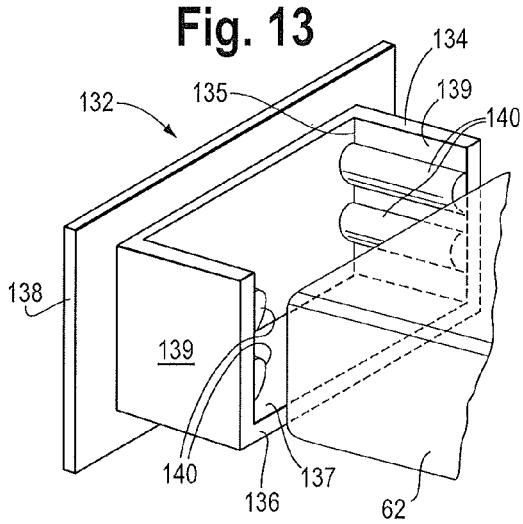
FIG. 13 is a perspective view of another plug according to the present invention.
Figure 14:
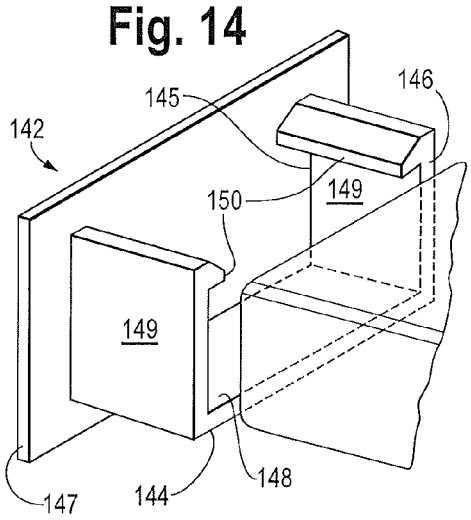
FIG. 14 is a perspective view of another plug according to the present invention.

FIGS. 13 and 14 are perspective views of still other "U-shaped" plugs suitable for use with a hollow or solid cross brace. The plug 132 of FIG. 13 comprises a substantially U-shaped body 134 having opposing ends 135, 136 and a flange 138 extending laterally from the proximal end 135. The plug body 134 comprises a bottom wall 137 having two ends and functioning as a ledge upon which the cross brace can rest and a side wall 139 extending upwardly from each end of the bottom wall 137. Ridges or projections 140, preferably rounded, extend inwardly from each sidewall 139 to facilitate a friction fit between the cross brace and the plug body 134.

The plug 142 of FIG. 14 comprises a substantially U-shaped body 144 having opposing ends 145, 146 and a flange 147 extending laterally from the proximal end 145. The plug body 144 comprises a bottom wall 148 having two ends and a side wall 149 extending upwardly from each bottom wall end to form a ledge upon which a cross brace can rest. Prongs or locks 150 extend inwardly from the top ends of the side walls 149 to prevent the cross brace from being easily removed once the cross brace is inserted within the plug body 144. The prongs 150 may be resilient and may have inwardly sloped or tapered top surfaces to facilitate insertion of a cross brace from above.

FIGS. 19 and 20 show yet another plug according to the invention. The plug 172 comprises a contoured body 174, opposing ends and a flange 176 extending laterally from one end. The plug body 174 is equipped with detents 178 that help register the plug 172 within openings in either the top cap 170 of FIG. 18 or the carton 14 of FIG. 1. The plug 172 may be used with a cross brace having similar contour, with the cross brace fitting over the plug body 174.

Fourth Embodiment

In a fourth embodiment the plugs are located inside the carton, rather than extending through apertures disposed in the carton side panels. In this embodiment each plug comprises a substantially cylindrical body that fits snugly within an open end of the cross brace, and a flange that extends laterally from one end of the plug body and abuts an interior surface of one of the carton panels. Each flange may include an adhesive surface on its carton facing side that adheres the plug to an interior surface of one of the carton panels.

Figure 17:
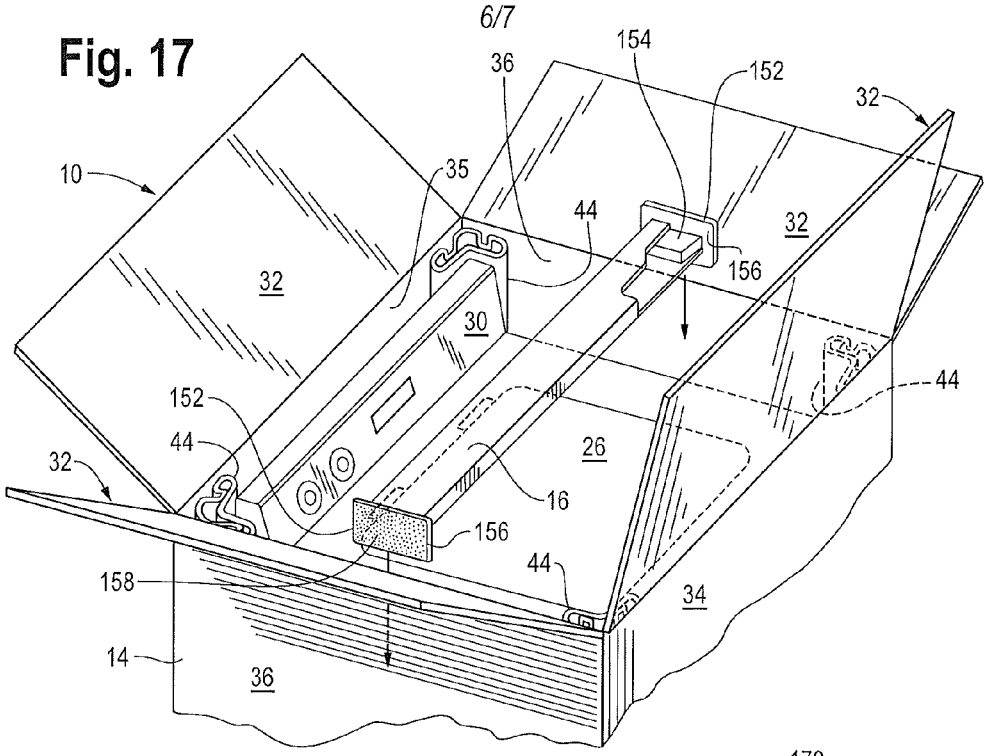
FIG. 17 is a perspective view of a fourth embodiment of a reinforced packaging system according to the present invention in which the plugs adhere to the internal surfaces of the sidewalls.

FIG. 17 is a perspective view of a reinforced packaging system in which the plugs 152 adhere to the internal surfaces of the carton walls. In the illustrated embodiment, a pair of plugs 152 are fitted into the open ends of a hollow tubular cross brace 16. The cross brace 16 and plugs 152 assembly may then be lowered into place inside a carton 14 until the cross brace 16 is in the desired location. Each plug 152 comprises a substantially cylindrical body 154 that fits snugly within an open end of the cross brace 16 and a flange 156 extending laterally from one end of the body 154. The flange 156 abuts an interior surface of one of the carton panels 36 and may include an adhesive surface 158 that adheres to the carton. The cross brace 16 and plugs 152 are configured to extend from one side of the carton to an opposite side.

Fifth Embodiment

In a fifth embodiment of the invention (not shown in the figures), the plugs again are located inside the carton, rather than extending through the carton side panels. In this embodiment—like that in FIG. 7—each plug comprises a substantially cylindrical body that fits snugly around an end of the cross brace, and a flange that extends laterally from one end of the plug body. Like the plug of FIG. 17, the flange abuts an interior surface of one of the carton panels. Each flange may include an adhesive surface on its carton facing side that adheres the plug to an interior surface of one of the carton panels.

Sixth Embodiment

Figure 18:
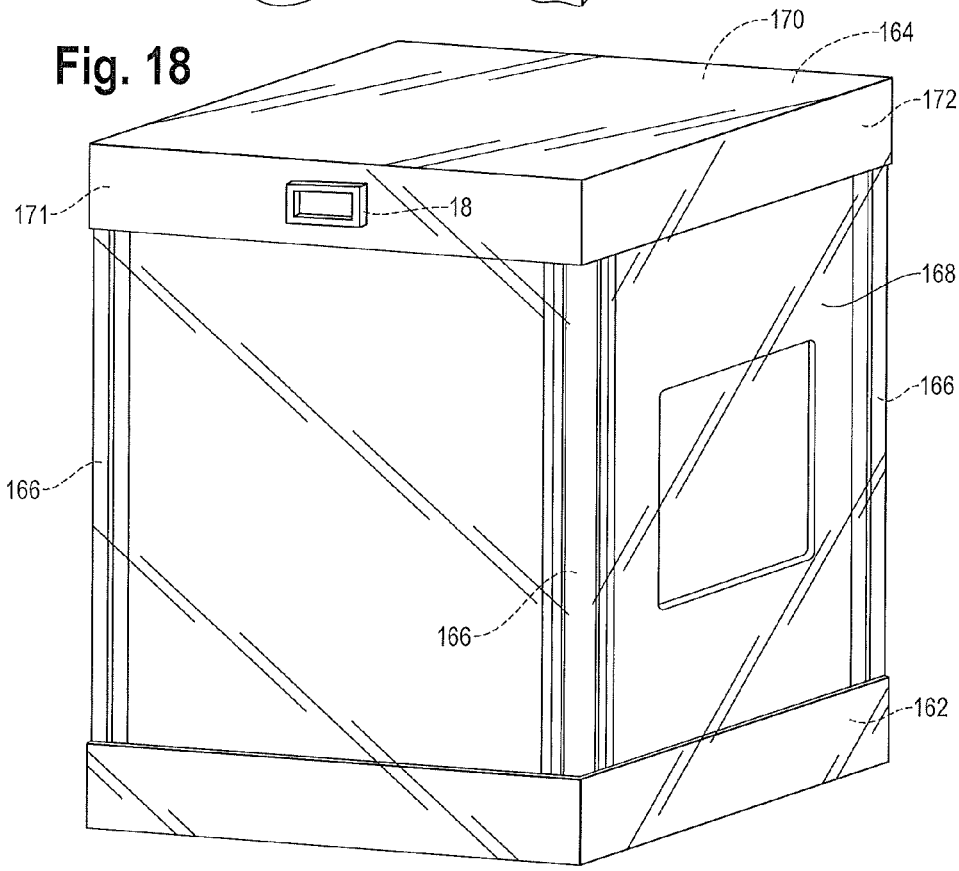
FIG. 18 is a perspective view of another embodiment of the invention, one in which a cross brace is used to reinforce a Clearview type packaging system.

In a sixth embodiment of the invention the carton is replaced by a Clearview packaging system having transparent sides. "Clearview" packages have open or transparent sides through which the packaged product can be viewed. Referring to FIG. 18, a typical Clearview package for a household appliance 160 comprises a base 162 and a top cap 164, corner posts 166 extending between the base 162 and top cap 164, and transparent plastic film 168 wrapped around the base 162, top cap 164 and corner posts 166. The top cap 164 typically comprises a top panel 170 and two short side panels 171 and front and rear panels 172 extending downward from the top panel 170.

FIG. 18 is a perspective view of a Clearview type packaging system reinforced according to the present invention. As shown in the illustrated embodiment, apertures are cut out of or otherwise formed in the two opposing top cap side panels 171. The apertures must be located such that there is clearance inside the package for the cross brace (not shown). The cross brace is positioned in the top cap 170 between the apertures. Plugs 18 are then inserted through the apertures so that the cross brace is held in position by the plugs 18. The top cap 170 and cross brace assembly is then positioned on the corner posts 166 and the entire unit is wrapped in transparent plastic film 168.

More particularly, the base 162 comprises a rectangular bottom panel having four corners. The top cap 164 comprises a rectangular top panel 170 having four corners and two sets of opposing peripheral edges, two side panels 171 extending downward from one set of opposing peripheral edges, each side panel having an aperture formed therein, and front and rear panels 172 extending downward from the other set of opposing peripheral edges. A corner post 166 extends between each of the four corners of the base 162 and each of the four corners of the top cap 164. The cross brace 16 (not shown) is positioned horizontally in the top cap 170 between the apertures. Each plug 18 has a body 50 and a flange 54 extending laterally from a proximal end 52 of the body 50, and is inserted into one of the two apertures so that the body 50 extends within the cross brace 16 and the flange 54 abuts an exterior surface of a top cap side panel 171. The plugs 18 position and secure the cross brace 16 within the top cap 172.

Variations of the reinforced Clearview package shown in FIG. 18 are contemplated. For example, the plugs may fit around the ends of the cross brace rather than inside the ends. Also, the plugs may fit inside the top cap and adhere or otherwise be affixed to the interior surfaces of the top cap side walls. Rather then extending through apertures in the top cap side walls.

It is understood that the embodiments of the invention described above are only particular examples, which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

We claim as our invention:

1. A reinforced packaging system for an article, the packaging system comprising:

a four sided carton disposed around the article and having a pair of opposing panels, each panel having an aperture extending there through;

a cross brace having opposing ends, the cross brace extending the between the opposing panels; and a pair of plugs each plug having a U-shaped body and a flange, the U-shaped body having opposing ends, a bottom wall having two side edges and a side wall extending vertically upwardly from each bottom side edge, the side walls defining an open top side, the flange extending laterally from the proximal end of the plug body, each plug being inserted into one of the two apertures so that the plug body extends into the carton and the flange abuts an exterior surface of a carton panel;

wherein each opposing end of the cross brace rests on one of the plug bottom walls; and wherein each plug further comprises projections extending inwardly from each sidewall to facilitate a friction fit between the cross brace and the plug body.

2. A reinforced packaging system for an article, the packaging system comprising:

a four sided carton disposed around the article and having a pair of opposing panels;

a cross brace having opposing ends, the cross brace extending the between the opposing panels; and a pair of plugs, each plug having a hollow body open at a distal end and closed at a proximal end, each plug further comprising a flange extending laterally from the proximal end of the body, each plug body fitting around the cross brace and each flange abutting an interior surface of one of the carton panels.

3. The reinforced packaging system of claim 2 wherein each flange includes an adhesive surface that adheres the plug flange to an interior surface of one of the carton panels.

4. A reinforced packaging system for an article, the packaging system comprising:

a four sided carton disposed around the article and having a pair of opposing panels;

a cross brace having opposing, hollow ends, the cross brace extending the between the opposing panels; and a pair of plugs, each plug comprising a substantially cylindrical body fitting within a hollow end of the cross brace and a flange extending laterally from one end of the body and abutting an interior surface of one of the carton panels;

wherein each flange includes an adhesive surface that adheres the plug to an interior surface of one of the carton panels.

* * * * *